US007833684B2

(12) United States Patent
Lincoln et al.

(10) Patent No.: US 7,833,684 B2
(45) Date of Patent: Nov. 16, 2010

(54) TONER COMPOSITIONS

(75) Inventors: Timothy L. Lincoln, Rochester, NY (US); Yuhua Tong, Webster, NY (US); Robert D. Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 417 days.

(21) Appl. No.: 11/939,608

(22) Filed: Nov. 14, 2007

(65) Prior Publication Data

US 2009/0123860 A1 May 14, 2009

(51) Int. Cl.
*G03G 9/08* (2006.01)

(52) U.S. Cl. ..... 430/108.2; 430/137.14

(58) Field of Classification Search ..... 430/108.2, 430/137.14

See application file for complete search history.

(56) References Cited

U.S. PATENT DOCUMENTS

| | | | | |
|---|---|---|---|---|
| 2,874,063 | A | 3/1953 | Greig | |
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,944,493 | A | 3/1976 | Jadwin et al. | |
| 3,983,045 | A | 9/1976 | Jugle et al. | |
| 4,007,293 | A | 2/1977 | Mincer et al. | |
| 4,079,014 | A | 3/1978 | Burness et al. | |
| 4,265,990 | A | 5/1981 | Stolka et al. | |
| 4,322,487 | A * | 3/1982 | Merrill et al. | 430/37 |
| 4,394,430 | A | 7/1983 | Jadwin et al. | |
| 4,560,635 | A | 12/1985 | Hoffend et al. | |
| 4,563,408 | A | 1/1986 | Lin et al. | |
| 4,584,253 | A | 4/1986 | Lin et al. | |
| 4,935,326 | A | 6/1990 | Creatura et al. | |
| 4,937,166 | A | 6/1990 | Creatura et al. | |
| 5,227,460 | A | 7/1993 | Mahabadi et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,853,943 | A | 12/1998 | Cheng et al. | |
| 6,004,714 | A | 12/1999 | Ciccarelli et al. | |
| 6,165,668 | A | 12/2000 | Wilson et al. | |
| 6,190,815 | B1 | 2/2001 | Ciccarelli et al. | |
| 6,221,550 | B1 | 4/2001 | Wilson et al. | |
| 6,647,230 | B2 | 11/2003 | Kobayashi et al. | |
| 6,692,634 | B1 | 2/2004 | Yakovlevich et al. | |
| 6,858,703 | B2 | 2/2005 | Allen et al. | |
| 2003/0191263 | A1 | 10/2003 | Yoshida et al. | |
| 2004/0002014 | A1 | 1/2004 | Chae et al. | |
| 2007/0218395 | A1 * | 9/2007 | Winters | 430/111.41 |

FOREIGN PATENT DOCUMENTS

| | | |
|---|---|---|
| EP | 1 383 011 A1 | 1/2004 |
| EP | 1 426 830 A1 | 6/2004 |

* cited by examiner

*Primary Examiner*—John L Goodrow
(74) *Attorney, Agent, or Firm*—Carter, DeLuca, Farrell & Schmidt, LLP

(57) ABSTRACT

A toner having charge control agents which impart excellent triboelectric charging characteristics.

19 Claims, No Drawings

TONER COMPOSITIONS

BACKGROUND

The present disclosure relates to toners and processes useful in providing toners suitable for electrostatographic apparatuses, including xerographic apparatuses such as digital, image-on-image, and similar apparatuses.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Charge control agents may be utilized to enhance triboelectric charging. Such agents may be applied to toner particle surfaces by a blending process. Charge control agents may be organic salts or complexes of large organic molecules. Such charge control agents may be used in small amounts of from about 0.01 weight percent to about 5 weight percent of the toner to control both the polarity of charge on a toner and the distribution of charge on a toner. Although the amount of charge control agents may be small compared to other components of a toner, charge control agents may be important for triboelectric charging properties of a toner. These triboelectric charging properties, in turn, may impact imaging speed and quality. Examples of charge control agents include those found in EP Patent Application No. 1426830, U.S. Pat. No. 6,652,634, EP Patent Application No. 1383011, U.S. Patent Application Publication No. 2004/002014, U.S. Patent Application Publication No. 2003/191263, U.S. Pat. No. 6,221,550, and U.S. Pat. No. 6,165,668.

Improved methods for producing toner, which decrease the production time and permit excellent control of the charging of toner particles, remain desirable.

SUMMARY

The present disclosure provides toner compositions and methods for preparing same. In embodiments, a toner of the present disclosure may include a toner particle including a latex, a pigment, and an optional wax, and a charge control agent including a triarylamine present in an amount from about 0.001 to about 20 weight percent of the toner.

In other embodiments, a toner of the present disclosure may include a toner particle including a latex, a pigment, and an optional wax, and a charge control agent including a triarylamine possessing functional groups such as phenol groups, hydroxyl groups, thiol groups, carboxylic acid groups, sulfonic acid groups, amino groups, and combinations thereof, with the triarylamine being present in an amount from about 0.01 to about 10 weight percent of the toner.

A process of the present disclosure may include contacting a latex, an aqueous pigment dispersion, and an optional wax dispersion to form a blend, adding a base to increase the pH of the blend to a value of from about 3.5 to about 7, heating the blend at a temperature below the glass transition temperature of the latex to form an aggregated toner, adding a charge control agent including a triarylamine to the aggregated toner, and recovering toner particles.

DETAILED DESCRIPTION OF EMBODIMENTS

The present disclosure provides toners and processes for the preparation of toner particles having excellent charging characteristics. Toners of the present disclosure may, in embodiments, include triarylamines as charge control agents.

The triarylamine charge control agents described herein may be utilized with any toner within the purview of those skilled in the art. In embodiments the charge control agents described herein may be utilized with conventional toners produced by melt-mixing resins and colorants, forming agglomerated particles, and grinding or similarly treating the agglomerated particles to form toner particles. In other embodiments, the charge control agents described herein may be utilized with toners produced by chemical synthesis methods, including emulsion aggregation toners.

Toners of the present disclosure may include a latex resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. As noted above, in embodiments the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymer may be block, random, or alternating copolymers. In addition, polyester resins obtained from the reaction products of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol, may also be used.

In embodiments, a poly(styrene-butyl acrylate) may be utilized as the latex. The glass transition temperature of this first latex, which in embodiments may be used to form the core of a toner of the present disclosure, may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine] di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis [2-(4,5 ,6,7-tetrahydro-H- 1 ,3-diazepin-2-yl)propane]dihydrochloride, 2,2'-azobis[2-(3,4,5,6tetrahydropyrimidin-2-yl) propane]dihydrochloride, 2,2'-azobis[2-(5-hydroxy-3,4,5,6-tetrahydropyrimidin -2-yl)propane]dihydrochloride, 2,2'-azobis {2-[1-(2- hydroxyethyl)-2-imidazolin-2-yl]propane} dihydrochloride, combinations thereof, and the like.

Initiators can be added in suitable amounts, such as from about 0.1 to about 8 weight percent, and in embodiments of from about 0.2 to about 5 weight percent of the monomers.

Chain Transfer Agents

In embodiments, chain transfer agents may also be utilized in forming the latex. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

Stabilizers

In embodiments, it may be advantageous to include a stabilizer when forming the latex particles. Suitable stabilizers include monomers having carboxylic acid functionality. Such stabilizers may be of the following formula (I):

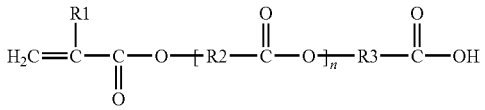

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl) acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax

Wax dispersions may also be added during formation of a latex in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Reaction Conditions

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter, as determined, for example, by a Brookhaven nanosize particle analyzer.

In embodiments, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex with the addition of the shell latex once aggregated particles have formed.

After formation of the latex particles, the latex particles may be utilized to form a toner. In embodiments, the toners may be an emulsion aggregation type toner that are prepared by the aggregation and fusion of the latex particles of the present disclosure with a colorant, and one or more additives such as surfactants, coagulants, waxes, surface additives, and optionally combinations thereof.

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330™ magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP68™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido) phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade. The chemical structures of PR-122, Pigment Red 269, and Pigment Red 185 (sometimes referred to herein as PR-185) are set forth below.

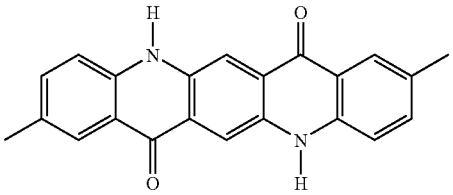

Pigment PR 122 (2.9-dimethylquinacridone)

-continued

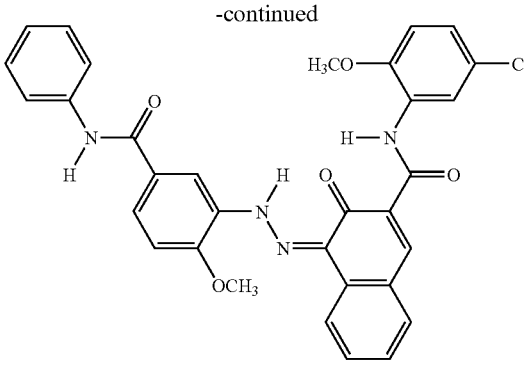

Pigment Red 269

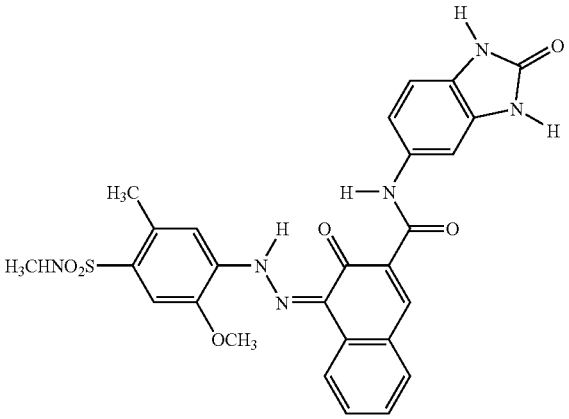

Pigment Red 185

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Aggregating Agents

Any aggregating agent capable of causing complexation might be used in forming toner of the present disclosure. Both alkali earth metal or transition metal salts can be utilized as aggregating agents. In embodiments, alkali (II) salts can be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

The resultant blend of latex, optionally in a dispersion, colorant dispersion, optional wax, optional coagulant, and optional aggregating agent, may then be stirred and heated to a temperature below the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 3 microns to about 15 microns in volume average diameter, in embodiments of from about 4 microns to about 8 microns in volume average diameter.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, colorant and optional wax is subsequently coalesced. Coalescing may include stirring and heating at a temperature of from about 80° C. to about 99° C., in embodiments from about 85° C. to about 98° C., for a period of from about 0.5 hours to about 12 hours, and in embodiments from about 1 hour to about 6 hours. Coalescing may be accelerated by additional stirring.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about 30 percent by weight of the mixture, and in embodiments from about 1 to about 20 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

After this cooling, the aggregate suspension may be heated to a temperature at or above the Tg of the latex. Where the particles have a core-shell configuration, heating may be above the Tg of the first latex used to form the core and the Tg of the second latex used to form the shell, to fuse the shell latex with the core latex. In embodiments, the aggregate suspension may be heated to a temperature of from about 80° C. to about 120° C., in embodiments from about 85° C. to about 98° C., for a period of time from about 1 hour to about 6 hours, in embodiments from about 2 hours to about 4 hours.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1 % by weight, in embodiments of less than about 0.7% by weight.

Charge Control Agents

As noted above, in embodiments toners of the present disclosure may include charge control agents. Suitable charge control agents for use in accordance with the present disclosure include triarylamines. In embodiments, suitable triarylamines may have functional groups such as phenol groups, hydroxyl groups, thiol groups, carboxylic acid groups, sulfonic acid groups, amino groups, and/or combinations thereof. Examples of suitable triarylamines include, but are not limited to, N,N'-diphenyl-N,N'-bis(3-hydroxyphenyl)-[1,1'-biphenyl]-4,4'-diamine (DHTBD); N,N-bis(p-methylphenyl),N-(4-hydroxylphenyl) amine; N,N-bis(p-methylphenyl),N-(4-carboxyphenyl) amine; N,N-bis(4-hydroxylphenyl),N-(4-methylphenyl) amine; 5-(N,N-bis(4-methylphenyl)amino) salicylic acid; Tris(4-hydroxylphenyl) amine; N-(4-methylphenyl), N-(4-hydroxylphenyl), N-(3-carboxy, 4-hydroxylphenyl) amine; N-(4-hydroxylphenyl), N-(4-carboxyphenyl), N-(3-carboxy, 4-hydroxylphenyl) amine; Tris(4-carboxyphenyl)amine; N-(2-methhyl, 4-hydroxylphenyl),N-(3-methyl, 4-carboxyphenyl), N-(3-carboxy, 4-hydroxylphenyl) amine; N,N'-bis(4-ethylphenyl)-N,N'-bis(3-carboxyl 4-hydroxylphenyl) [1,1'-biphenyl] 4,4'-diamine; N,N'-bis(4-methylphenyl)-N,N'-bis(4-hydroxylphenyl) [1,1-biphenyl] 4,4'-diamine; N,N'-bis(1,1-biphenyl)-N,N'-bis(3-carboxy, 4-hydroxylphenyl)[1,1'-biphenyl] 4,4'diamine; N,N'-bis(4-ethylphenyl)-N,N'-bis(3-methyl, 4-hydroxylphenyl) [1,1'-biphenyl] 4,4'-diamine; N,N'-bis(3-methylphenyl, 4-carboxy)-N,N'-bis (3-carboxyphenyl) [1,1'-biphenyl] 4,4'-diamine; N,N'-bis(3,4-dimethylphenyl)-N,N'-bis (3-carboxy, 4-hydroxylphenyl) [1,1'-biphenyl] 4,4'-diamine; N,N'-bis(3-methylphenyl)-N,N'-bis(3-carboxyphenyl) [1,1'-biphenyl] 4,4'-diamine; N,N'-bis(3-methylphenyl, 4-carboxy)-N,N'-bis(3-carboxy, 4-hydroxylphenyl) [1,1'- biphenyl]4,4'-diamine; N,N'-diphenyl-N,N'-bis(3-hydroxylphenyl)[p-terphenyl] 4,4'-diamine; N,N'-diphenyl-N-(3-carboxymethylphenyl),N'-(3-carboxyethylphenyl) [1,1'-biphenyl] 4,4'-diamine; N,N'-diphenyl-N,N'-bis(3-hydroxyl, 4-carboxyphenyl) [p-terphenyl] 4,4'-diamine; N,N'-bis(3-hydroxylphenyl)-N,N'-bis(3-nitrophenyl) [1,1'-biphenyl] 4,4'-diamine; derivatives of the foregoing, and combinations thereof.

The triarylamines utilized as charge control agents may be present in effective amounts of, for example, from about 0.001 to about 20 weight percent of the toner, in embodiments from about 0.01 to about 10 weight percent of the toner.

The toner may also include other charge additives in effective amounts of, for example, from about 0.01 to about 10 weight percent of the toner, in embodiments from about 0.05 to about 7 weight percent of the toner. Additional suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, combinations thereof, and the like.

Charge control agents such as triarylamines may be combined with toner particles utilizing any method within the purview of one skilled in the art, including, blending, mixing, paint shaking, sonication, coating, grafting, combinations thereof, and the like for a suitable period of time from about 5 minutes to about 80 minutes, in embodiments from about 10 minutes to about 60 minutes. For example, in embodiments, magenta toner particles may be combined with a triarylamine such as DHTBD by paint shaking for a period of time from about 5 minutes to about 80 minutes, in embodiments from about 10 minutes to about 60 minutes.

The triboelectric charge on toner particles of the present disclosure utilizing the charge control agents described above may be from about 5 μC/g to about 100 μC/g, in embodiments from about 20 μC/g to about 60 μC/g, depending, in part, upon the length of time the triarylamine and toner particles are shaken, as well as the materials utilized to form the toner particles. The interaction of a triarylamine such as DHTBD and toner particles should be strong and stable during milling to provide stable triboelectric charging behavior.

As the surfaces of emulsion aggregation toners particle may possess electron acceptor carbonyl (C═O) groups like carboxylic acids and esters, a charge control agent possessing electron donor groups like triarylamines may be able to undergo strong hydrogen bonding between the charge control agent and toner particle. This strong interaction between electron donor groups and electron acceptor groups may also enhance the charge transfer/ion transfer in surface friction, which may lead to excellent triboelectric charging. As a result, this may stabilize the triboelectric charging of the toner in a short period of time.

The charge control agents herein may chemically interact with the toner particles and have excellent triboelectric characteristics, including excellent charging efficiency, even with the use of low amounts of charge control agents compared with conventional toners.

The use of triarylamines as charge control agents may thus have enhanced chemical interactions with toner particles thereby reducing the amount of charge control agent necessary to obtain the desired triboelectric charge. Therefore a high triboelectric charging efficiency may be obtained and low amounts of charge control agents may be required to obtain a desired triboelectric charge.

The toner particles possessing triarylamine charge control agents may have excellent compatibility with other resins and pigments. Resulting toner particles have excellent triboelectric robustness, for example the ability to retain a uniform triboelectric charge. This ability to retain a uniform triboelectric charge may help reduce the number of toner failure modes in an apparatus utilizing such a toner, and also increase productivity and reduce the unit manufacturing cost (UMC) for the toner by reducing the time required to produce the toner, as well as reducing the need for additional processing or other additives to obtain suitable toner particles.

Other Additives

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Following the methods of the present disclosure, toner particles may be obtained having several advantages compared with conventional toners: (1) increase in the robustness of the particles' triboelectric charging, which reduces the toner defects and improves the machine performance; (2) easy to implement, no major changes to existing aggregation/coalescence processes; (3) and increase in productivity and reduction in unit manufacturing cost (UMC) by reducing the production time and the need for rework (quality yield improvement).

Uses

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Latex preparation. An emulsion aggregation magenta toner was prepared as follows. A monomer emulsion was prepared by agitating a monomer mixture (about 630 grams of styrene, about 140 grams of n-butyl acrylate, about 23.2 grams of beta-carboxyethyl acrylate (β-CEA) and about 5.4 grams of 1-dodecanethiol) with an aqueous solution (about 15.3 grams of DOWFAX 2A1 (an alkyldiphenyloxide disulfonate surfactant from Dow Chemical), and about 368 grams of deionized water) at about 300 revolutions per minute (rpm) at a temperature from about 20° C. to about 25° C.

About 1.1 grams of DOWFAX 2A1 (about 47% aqueous) and about 736 grams of deionized water were charged in a 2 liter jacketed stainless steel reactor with double P-4 impellers set at about 300 rpm, and deaerated for about 30 minutes while the temperature was raised to about 75° C.

About 11.9 grams of the monomer emulsion described above was then added into the stainless steel reactor and was stirred for about 8 minutes at about 75° C. An initiator solution prepared from about 11.6 grams of ammonium persulfate in about 57 grams of deionized water was added to the reactor over about 20 minutes. Stirring continued for about an additional 20 minutes to allow seed particle formation. About 407 grams of the remaining monomer emulsion was fed into the reactor over about 130 minutes. A latex having a particle size of about 150 nm was formed at this point, with a Mw of about 50 kg/mole (as determined by gel permeation chromatography (GPC)). After waiting about 20 minutes, the rest of the monomer solution was added over a period of about 90 minutes. After the addition, the latex was stirred at the same temperature for about 3 more hours. The final latex particle size was about 220 nm, having a molecular weight of about 38,000.

Example 2

Toner particle preparation. About 225 grams of the latex prepared in Example 1 above was combined with about 50 grams of a PR-122 pigment dispersion, about 8.7 grams of a PR-185 pigment dispersion (from Sun Chemicals Co.), about 30.1 grams of a polyethylene wax POLYWAX 725® dispersion (Mw of about 725, about 31 percent active, available from Baker Petrolite Company), and about 1000 ml of deionized water. The components were mixed by a homogenizer. A separate mixture of about 2.7 grams of poly(aluminum chloride) (from Asada Co.) in about 24.6 grams of 0.02 M of $HNO_3$ solution was added dropwise into the reactor. After the addition of the poly(aluminum chloride) mixture, the resulting viscous slurry was homogenized at about 22° C. for about 8 minutes. The reaction temperature was then raised to about 59° C., at which point the particle size was about 6.2 microns.

About 105 grams of the latex prepared above in Example1 was then added dropwise. After the addition of the latex, the resulting slurry was stirred for about 15 minuets, and about 1 M of NaOH was added into the slurry to adjust the pH to about 5. After mixing for an additional 20 minutes, the slurry was heated to about 96° C., and the pH of the slurry was adjusted to about 4.2 by the addition of about 0.3 M $HNO_3$ solution. After the adjustment of the pH, the slurry was coalesced for about 2.5 hours, and the toner particles thus obtained were collected by filtration. After washing and drying, the diameter of the resulting magenta toner particles was about 8.12 microns.

Example 3

About 100 grams of the magenta toner particles from Example 2 were blended with about 1.09 g of N,N'-diphenyl-N,N'-bis(3-hydroxyphenyl)-[1,1'-biphenyl]-4,4'-diamine (DHTBD), by a roll-mill at about 200 rpm for about 15 hours.

About 6 grams of the resulting blended particles were then added to about 100 grams of oxidized sponge iron carrier cores (about 90μ diameter) available from Hoeganaes Corporation and subjected to paint shaking. Three separate samples were prepared in this manner with varying times of paint shaking, i.e., the three samples were paint shaken for about 10 minutes, about 30 minutes and about 60 minutes, respectively. The triboelectric charge of the resulting particles was obtained by using a Faraday Cage blow off apparatus after conditioning the samples for about 24 hours to determine the charging behavior of the resulting particles: one sample was conditioned at about 20 percent relative humidity; the other sample was conditioned at about 80 percent relative humidity.

Comparative Example 1

About 100 grams of the magenta toner particles produced as described in Example 3 were blended with about 3.5 grams of a silica/titania combination at a ratio of silica to titania of about 4:1. About 6 grams of the resulting blended particles were then added to about 100 grams of the (about 90μ diameter) oxidized sponge iron carrier cores available from Hoeganaes Corporation as described above in Example 3, with three samples prepared and paint shaken for about 10 minutes, about 30 minutes and about 60 minutes, respectively as described in Example 3. Triboelectric charging was obtained for each sample as described above in Example 3.

The triboelectric charges obtained for the samples from Example 3 and this Comparative Example1 are set forth below in Table 1.

TABLE 1

| | Mixing Time (minutes) | | |
|---|---|---|---|
| | 10 | 30 | 60 |
| Example 3 (Triboelectric Charge) | 29.13 μC/g | 30.55 μC/g | 29.54 μC/g |
| Comparative Example 1 (Triboelectric Charge) | 24.47 μC/g | 27.07 μC/g | 32.47 μC/g |

As can be seen from Table1 above, the triboelectric charge of the blended toner of the present disclosure was about 29.13 μC/g for about 10 minutes of paint shaking, and about 30.55 μC/g for about 30 minutes of paint shaking. In comparison, the control toner with about 3.5% silica/titania resulted in a triboelectric charge of about 24.47 μC/g for about 10 minutes of paint shaking and about 27.07 μC/g for about 30 minutes of paint shaking. These results demonstrate that the triarylamines utilized in accordance with the present disclosure efficiently enhanced the toner triboelectric charging and stabilized the triboelectric charging of an emulsion aggregation toner in a very short period of time.

The above results also confirmed that a triarylamine such as DHTBD was an excellent charge control agent for an emulsion aggregation toner giving good triboelectric stability over time. Furthermore, the toner possessing the triarylamine charge control agent obtained a steady state in a very short time period as compared to the control, which was still rising.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a toner particle comprising a latex, a pigment, and an optional wax; and a charge control agent comprising a triarylamine present in an amount from about 0.001 to about 20 weight percent of the toner, wherein the toner particle possesses a triboelectric charge of from about 5 μC/g to about 100 μC/g.

2. A toner as in claim 1, wherein the latex is selected from the group consisting of styrenes, acrylates, methacrylates, butadienes, isoprenes, acrylic acids, methacrylic acids, acrylonitriles, and combinations thereof, and the latex has a glass transition temperature from about 35° C. to about 75° C.

3. A toner as in claim 1, wherein the latex is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

4. A toner as in claim 1, wherein the pigment comprises a magenta pigment selected from the group consisting of Pigment Red 122, Pigment Red 185, Pigment Red 192, Pigment Red 202, Pigment Red 206, Pigment Red 235, Pigment Red 269, and combinations thereof.

5. A toner as in claim 1, wherein the triarylamine possesses functional groups selected from the group consisting of phenol groups, hydroxyl groups, thiol groups, carboxylic acid groups, sulfonic acid groups, amino groups, and combinations thereof.

6. A toner as in claim 1, wherein the triarylamine is selected from the group consisting of N,N'-diphenyl-N,N'-bis(3-hydroxyphenyl)-[1,1'-biphenyl]-4,4'-diamine, N,N-bis(p-methylphenyl),N-(4-hydroxylphenyl) amine, N,N-bis(p-methylphenyl), N-(4-carboxyphenyl) amine, N,N-bis(4-hydroxylphenyl),N-(4-methylphenyl) amine, 5-(N,N-bis(4-methylphenyl)amino) salicylic acid, Tris(4-hydroxylphenyl) amine, N-(4-methylphenyl), N-(4-hydroxylphenyl),N-(3-carboxy, 4-hydroxylphenyl) amine,N-(4-hydroxylphenyl), N-(4-carboxyphenyl),N-(3-carboxy, 4-hydroxylphenyl) amine, Tris(4-carboxyphenyl)amine, N-(2-methyl, 4-hydroxylphenyl), N-(3 -methyl, 4-carboxyphenyl), N-(3-carboxy, 4-hydroxylphenyl) amine, N,N'-bis(4-ethylphenyl)-N,N'-bis(3-carboxyl 4-hydroxylphenyl) [1,1'-biphenyl] 4,4'-diamine, N,N'-bis(4-methylphenyl)-N,N'-bis(4-hydroxylphenyl) [1,1'-biphenyl] 4,4'-diamine, N,N'-bis(1,1'-biphenyl)-N,N'-bis(3-carboxy, 4-hydroxylphenyl) [1,1'-biphenyl] 4,4'-diamine, N,N'-bis(4-ethylphenyl)-N,N'-bis(3-methyl, 4-hydroxylphenyl) [1,1'-biphenyl] 4,4'-diamine, N,N'-bis(3-methylphenyl, 4-carboxy)-N,N'-bis(3-carboxyphenyl) [1,1'-biphenyl] 4,4'-diamine, N,N'-bis(3,4-dimethylphenyl)-N,N'-bis(3-carboxy, 4-hydroxylphenyl) [1,1'-biphenyl] 4,4'-diamine, N,N' -bis(3-methylphenyl)-N,N' -bis (3-carboxyphenyl) [1,1'-biphenyl] 4,4' -diamine, N,N'-bis(3-methylphenyl, 4-carboxy)-N,N'-bis(3-carboxy, 4-hydroxylphenyl) [1,1'-biphenyl] 4,4'-diamine, N,N'-diphenyl-N,N'-bis(3-hydroxylphenyl)[p-terphenyl] 4,4'-diamine, N,N'-diphenyl-N-(3-carboxymethylphenyl), N'-(3-carboxyethylphenyl) [1,1'-biphenyl] 4,4'-diamine, N,N'-diphenyl-N, N-bis(3-hydroxyl, 4-carboxyphenyl) [p-terphenyl] 4,4'-diamine, N,N'-bis(3-hydroxylphenyl)-N, N'-bis(3-nitrophenyl) [1,1'-biphenyl] 4,4'-diamine, and combinations thereof.

7. A toner as in claim 1, wherein the latex comprises a poly(styrene-butyl acrylate), the toner particle has a size from about 1 micron to about 20 microns, and the toner particle has a circularity of from about 0.9 to about 0.99.

8. A toner as in claim 1, wherein the toner particle further comprises a stabilizer of formula

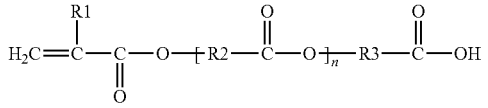

(I)

wherein R1 is selected from the group consisting of hydrogen and methyl, R2 and R3 are independently selected from the group consisting of alkyl groups having from about 1 to about 12 carbon atoms and phenyl groups, and n is from about 0 to about 20.

9. A toner as in claim 8, wherein the stabilizer is selected from the group consisting of beta carboxyethyl acrylate, poly (2-carboxyethyl) acrylate, 2-carboxyethyl methacrylate, acrylic acid, and acrylic acid derivatives.

10. A toner comprising:

a toner particle comprising a latex, a pigment, and an optional wax; and a charge control agent comprising a triarylamine possessing functional groups selected from the group consisting of phenol groups, hydroxyl groups, thiol groups, carboxylic acid groups, sulfonic acid groups, amino groups, and combinations thereof present in an amount from about 0.01 to about 10 weight percent of the toner, wherein the toner particle possesses a triboelectric charge of from about 5 μC/g to about 100 μC/g.

11. A toner as in claim 10, wherein the latex is selected from the group consisting of poly(styrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

12. A toner as in claim 10, wherein the pigment comprises a magenta pigment selected from the group consisting of Pigment Red 122, Pigment Red 185, Pigment Red 192, Pigment Red 202, Pigment Red 206, Pigment Red 235, Pigment Red 269, and combinations thereof.

13. A toner as in claim 10, wherein the triarylamine is selected from the group consisting of N,N'-diphenyl-N,N'-bis (3-hydroxyphenyl)-[1,1'-biphenyl]-4,4'-diamine, N,N-bis(p-methylphenyl),N-(4-hydroxylphenyl) amine, N,N-bis(p-methylphenyl), N-(4-carboxyphenyl) amine, N,N-bis(4-hydroxylphenyl),N-(4-methylphenyl) amine, 5-(N,N-bis(4-methylphenyl)amino) salicylic acid, Tris(4-hydroxylphenyl) amine, N-(4-methylphenyl), N-(4-hydroxylphenyl),N-(3-carboxy, 4-hydroxylphenyl)amine, N-(4-hydroxylphenyl), N-(4-carboxyphenyl), N-(3-carboxy, 4-hydroxylphenyl) amine, Tris(4-carboxyphenyl)amine, N-(2-methyl, 4-hydroxylphenyl), N-(3-methyl, 4-carboxyphenyl), N-(3 -carboxy, 4-hydroxylphenyl) amine, N,N'-bis(4-ethylphenyl)-N,N'-bis(3-carboxyl 4-hydroxylphenyl) [1,1'-biphenyl] 4,4'-diamine, N,N'-bis(4-methylphenyl)-N,N'-bis(4-hydroxylphenyl) [1,1'-biphenyl] 4,4'-diamine, N,N'-bis(1,1'-biphenyl)-N,N'-bis(3-carboxy, 4-hydroxylphenyl) [1,1'-biphenyl] 4,4'-diamine, N,N'-bis(4-ethylphenyl)-N,N'-bis(3-methyl, 4-hydroxylphenyl) [1,1'-biphenyl] 4,4'-diamine, N,N'-bis(3-methylphenyl, 4-carboxy)-N,N'-bis(3-carboxyphenyl) [1,1'-biphenyl] 4,4'-diamine, N,N'-bis(3,4-dimethylphenyl)-N,N'-bis(3-carboxy, 4-hydroxylphenyl) [1,1'-biphenyl] 4,4'-diamine, N,N'-bis(3-methylphenyl1)-N,N'-bis (3-carboxyphenyl) [1,1'-biphenyl] 4,4'-diamine, N,N'-bis(3-methylphenyl, 4-carboxy)-N,N'-bis(3-carboxy, 4-hydroxylphenyl) [1,1'-biphenyl] 4,4'-diamine, N,N'-diphenyl-N,N'-bis(3-hydroxylphenyl)[p-terphenyl] 4,4'-diamine, NN'-diphenyl-N-(3- carboxymethylphenyl), N'-(3-carboxyethylphenyl) [1,1'-biphenyl] 4,4'-diamine, N,N'-diphenyl-N, N'-bis(3-hydroxyl, 4-carboxyphenyl) [p-terphenyl] 4,4'-diamine, N,N'-bis(3-hydroxylphenyl)-N, N'-bis(3-nitrophenyl) [1,1'-biphenyl] 4,4'-diamine, and combinations thereof.

14. A toner as in claim 10, wherein the toner particles have a size from about 1 micron to about 20 microns, a circularity from about 0.9 to about 0.99, and a triboelectric charge of from about 20 μC/g to about 60 μC/g.

15. A toner as in claim 10, wherein the toner particles further comprise a stabilizer selected from the group consisting of beta carboxyethyl acrylate, poly(2-carboxyethyl) acrylate, 2-carboxyethyl methacrylate, acrylic acid, and acrylic acid derivatives.

16. A process comprising:

contacting a latex, an aqueous pigment dispersion, and an optional wax dispersion to form a blend;

adding a base to increase the pH of the blend to a value of from about 3.5 to about 7;

heating the blend at a temperature below the glass transition temperature of the latex to form an aggregated toner;

adding a charge control agent comprising a triarylamine to the aggregated toner; and recovering toner particles, wherein the resulting toner particles possesses a triboelectric charge of from about 5 μC/g to about 100 μC/g.

17. A process as in claim 16, wherein adding the charge control agent comprising the triarylamine to the aggregated toner comprises adding by a method selected from the group consisting of blending, mixing, shaking, paint shaking, sonication, and combinations thereof, for a period of time from about 5 minutes to about 80 minutes.

18. A process as in claim 16, wherein the latex is selected from the group consisting of styrenes, acrylates, methacrylates, butadienes, isoprenes, acrylic acids, methacrylic acids, acrylonitriles, and combinations thereof, and wherein the triarylamine possesses functional groups selected from the group consisting of phenol groups, hydroxyl groups, thiol groups, carboxylic acid groups, sulfonic acid groups, amino groups, and combinations thereof.

19. A process as in claim 16, wherein the triarylamine is selected from the group consisting of N,N'-diphenyl-N,N'-bis (3-hydroxyphenyl) [1,1'-biphenyl]-4, 4'-diamine, N,N-bis(p-methylphenyl),N-(4-hydroxylphenyl) amine, N,N-bis(p-methylphenyl), N-(4-carboxyphenyl) amine, N,N-bis(4-hydroxylphenyl),N-(4-methylphenyl) amine, 5-(N,N-bis(4-methylphenyl)amino) salicylic acid, Tris(4-hydroxylphenyl) amine, N-(4-methylphenyl), N-(4-hydroxylphenyl),N-(3-carboxy, 4-hydroxylphenyl) amine, N-(4-hydroxylphenyl), N-(4-carboxyphenyl),N-(3-carboxy, 4-hydroxylphenyl) amine, Tris(4-carboxyphenyl)amine, N-(2-methyl, 4-hydroxylphenyl), N-(3-methyl, 4-carboxyphenyl), N-(3-carboxy, 4-hydroxylphenyl) amine, N,N'-bis(4-ethylphenyl)-N, N'-bis(3-carboxyl 4-hydroxylphenyl) [1,1' -biphenyl] 4,4' -diamine, N,N'-bis(4-methylphenyl)-N,N'-bis(4-hydroxylphenyl) [1,1' -biphenyl] 4,4'-diamine, N,N'-bis(1,1'-biphenyl)-N,N'-bis(3-carboxy, 4-hydroxylphenyl) [1,1'-biphenyl] 4,4'-diamine, N,N'-bis(4-ethylphenyl)-N,N'-bis(3-methyl, 4-hydroxylphenyl) [1,1'-biphenyl] 4,4'-diamine, N,N'-bis(3-methylphenyl, 4-carboxy)-N,N'-bis(3-carboxyphenyl) [1,1'-biphenyl] 4,4'-diamine, N,N'-bis(3,4-dimethylphenyl)-N,N'-bis(3-carboxy, 4-hydroxylphenyl) [1,1'-biphenyl] 4,4'-diamine, N,N'-bis(3-methylphenyl)-N, N'-bis(3-carboxyphenyl) [1,1'-biphenyl] 4,4'-diamine, N,N'-bis(3-methylphenyl, 4-carboxy)-N, N'-bis(3-carboxy, 4-hydroxylphenyl) [1,1'-biphenyl] 4,4'-diamine, N,N'-diphenyl-N, N'-bis(3-hydroxylphenyl)[-terphenyl] 4,4'-diamine, N,N'-diphenyl-N-(3-carboxymethylphenyl), N'-(3-carboxyethylphenyl) [1,1'-biphenyl] 4,4'-diamine, N,N'-diphenyl-N, N'-bis(3-hydroxyl, 4-carboxyphenyl) [p-terphenyl] 4,4'-diamine, N,N'-bis(3-hydroxylphenyl)-N, N'-bis(3-nitrophenyl) [1,1'-biphenyl] 4,4'-diamine, and combinations thereof, and wherein the resulting toner particles have a size from about 1 micron to about 20 microns, a circularity from about 0.9 to about 0.99, and a triboelectric charge of from about 20 μC/g to about 60 μC/g.

* * * * *